US006680589B2

(12) United States Patent
Neranjan et al.

(10) Patent No.: US 6,680,589 B2
(45) Date of Patent: Jan. 20, 2004

(54) RELAY CONTACT MONITORING DEVICE

(75) Inventors: David D. Neranjan, Miami, FL (US); Mark O. Gerwig, Pembrooke Pines, FL (US)

(73) Assignee: A-l Components, Corp., Hialeah, FL (US)

( * ) Notice: Subject to any disclaimer, the term of this patent is extended or adjusted under 35 U.S.C. 154(b) by 0 days.

(21) Appl. No.: 09/924,690

(22) Filed: Aug. 8, 2001

(65) Prior Publication Data

US 2003/0030392 A1 Feb. 13, 2003

(51) Int. Cl.[7] ..... H02P 1/54; H02P 5/46; H02P 7/68

(52) U.S. Cl. ..... 318/34; 318/5; 318/6; 318/7; 318/8; 318/19; 318/101; 318/103; 318/799; 318/800

(58) Field of Search ..... 318/34, 5–8, 19, 318/101, 103, 799, 800

(56) References Cited

U.S. PATENT DOCUMENTS 3,710,214 A * 1/1973 Anderson ..... 318/102
4,267,704 A * 5/1981 Yapp ..... 62/158
5,041,775 A * 8/1991 Erdman ..... 318/812
5,272,427 A * 12/1993 Nold et al. ..... 318/672
5,492,273 A * 2/1996 Shah ..... 236/44 A
5,572,104 A * 11/1996 Nold et al. ..... 318/672
5,594,312 A * 1/1997 Schwendemann et al. .. 318/799
6,002,218 A * 12/1999 Toda et al. ..... 318/66
6,021,955 A * 2/2000 Pasch et al. ..... 236/49.3
6,116,513 A * 9/2000 Perhats, Sr. ..... 237/2 A

* cited by examiner

*Primary Examiner*—Robert Nappi
*Assistant Examiner*—Tyrone Smith
(74) *Attorney, Agent, or Firm*—Carlson, Gaskey & Olds

(57) ABSTRACT

A device for monitoring the state of relay contacts is especially useful for controlling motor windings in air conditioning systems. When a first relay switch, which is operative to supply power to a first motor winding does not open as desired, a switch monitoring module responsively controls the second relay switch energization to prevent the second relay switch from being closed. This prevents power that would be supplied to a second motor winding from being also supplied to the first motor winding and causing potential damage to the first motor winding. A disclosed example includes an opto isolator that is energized only when the first relay switch is open as desired. The opto isolator controls an output signal to a second relay control portion, which only operates the second relay if the first relay has opened as required.

10 Claims, 2 Drawing Sheets

RELAY CONTACT MONITORING DEVICE

BACKGROUND OF THE INVENTION

This invention generally relates to motor control in air conditioning systems. More particularly, this invention relates to monitoring the condition of relay contacts for controlling motors in air conditioning systems.

Typical air conditioning systems have compressors and blowers. A variety of strategies for powering the compressors and blowers are in use. One arrangement includes relay switches that are operated to selectively supply power to various portions of the blower motor, for example. In one arrangement, a blower motor includes two windings. One winding is powered to operate the blower at a low speed while a second winding is powered to operate at a high speed.

It has been found that during installation, for example, the relay contacts for controlling the low blower speed have been inadvertently welded together when the relay contacts should be normally opened. Having relay contacts that do not operate properly presents the potential for supplying excessive power to the low speed blower motor winding, for example, which results in a need for repair or replacement. This is one example situation where relay contact operation should be monitored to prolong the longevity of the product and components.

There is a need for a device that monitors the operation of relay contacts and controls associated components to prevent, for example, excessive power being supplied to certain components under certain operating conditions. This invention addresses that need.

SUMMARY OF THE INVENTION

This invention is a relay contact monitoring device that is able to detect when at least one relay contact is not operating as intended and responsively controls the operation of selected components to avoid an undesirable result caused by the non-operating relay contacts.

A device designed according to this invention includes a monitoring portion that monitors a voltage across the contacts of a selected relay switch. If an expected voltage is not present, the monitoring portion responsively controls the supply of power to at least one other component to prevent an undesirable amount of power being transmitted across the monitored relay switch.

In one example, the relay monitoring portion includes an opto isolator that operates responsive to the presence of a voltage across the selected relay switch contacts. When the relay switch operates as expected, the opto isolator is de-energized. When the relay switch releases as expected, the opto isolator is energized and provides an output signal for energizing another component, which in turn, controls the operation of a second relay switch. In the event that the first relay switch is not operating as intended, the opto isolator is not energized and the output signal for operating the other component is not provided.

This invention is particularly well suited for controlling the supply of power to a two stage motor having a first winding that is powered at a first level for a low blower operation level and a second winding that is powered at a second, higher power level for a high blower operation. Of course, this invention is not limited to such an arrangement and the various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
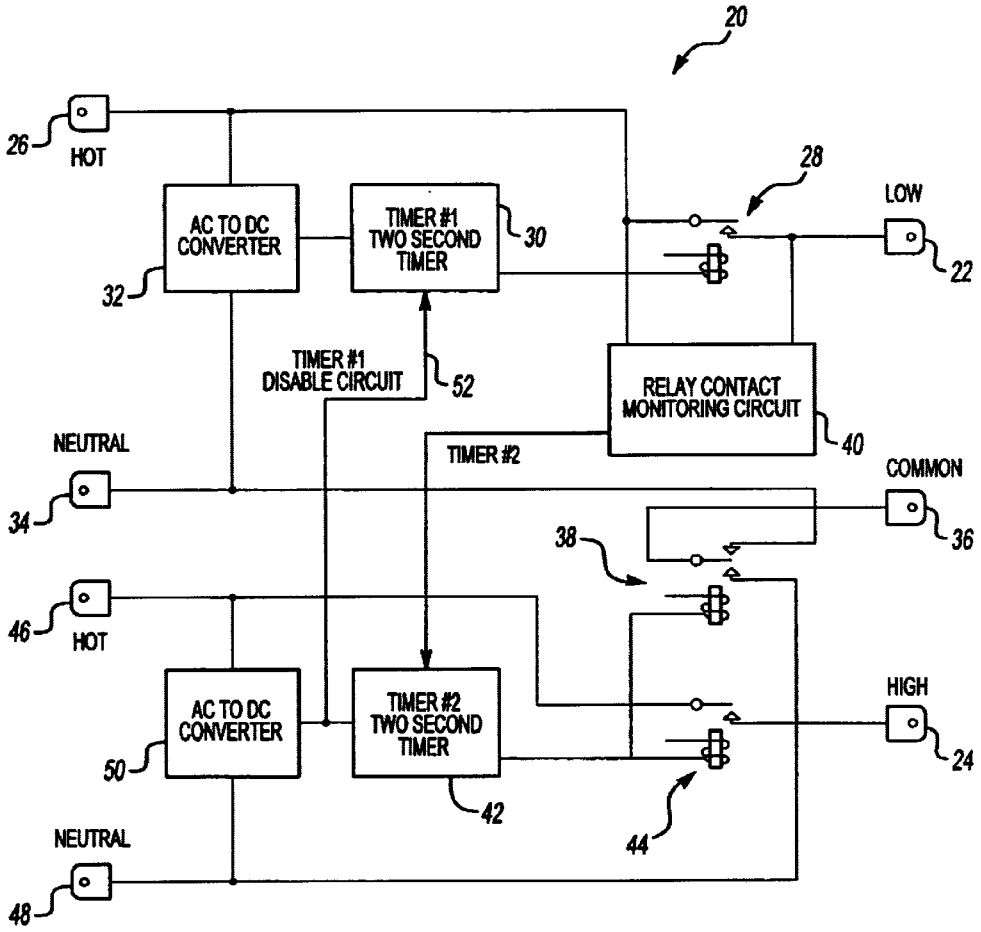
FIG. 1 schematically illustrates a system designed according to this invention.

Selected portions of an air conditioner system 20 are schematically shown in FIG. 1. A blower portion includes a two stage motor, which operates at a low speed and a high speed, respectively. A first winding 22 of the motor is energized when the low blower operation is required. A second winding 24 is energized, preferably at a higher power level, to achieve a high level of blower operation.

When the blower should be operated at the low level, power is supplied through the lead 26 and through a relay switch arrangement 28 to the low motor winding 22. A timer module 30 preferably controls the energization of the relay switch contacts 28 to close the switch so that power is transmitted to the low motor winding 22.

The illustrated example includes an ac to dc voltage converter 32 so that dc voltage can be used as part of the timer module 30. In one example, the timer module 30 includes discrete circuit components. In another example, the timer module 30 is at least a portion of a microprocessor.

When the relay switch 28 is closed, it is possible for power to be conducted along the circuit from the lead 26, across the switch 28, through the neutral lead 34 to power the low motor winding 22. A normally closed relay switch 38 preferably controls the flow of power by completing the circuit to motor common lead 36.

During operation of the arrangement 20, a relay monitoring module 40 monitors the state of the relay switch 28. The illustrated example includes a normally open relay switch 28. The monitoring module 40 preferably detects a voltage across the contacts of the relay switch 28. When no voltage is present, that indicates that the relay switch is closed. The monitoring module 40 preferably controls a second timer module 42 based upon the state of the relay switch 28.

Whenever the relay switch 28 is closed, the monitoring module 40 preferably disables the timer module 42 so that the relay switch 44 may not be energized and no power is supplied to the high speed motor winding 24. When the relay switch 44 is open, no power can be conducted along the circuit from the lead 46 through switch 44, through switch 38, through the lead 48 because the switch 44 is open.

When it is desirable to operate the motor at high speed, preferably a signal comes in through the lead 46, is processed by an AC-to-DC converter 50 and utilized by a timer disable portion 52 to disable the first timer module 30. At this point, the relay switch 28 opens, assuming that the relay is operating as intended. When the relay switch 28 is opened, the monitoring module 40 detects a voltage across the switch contacts and provides an output signal to the second timer module 42. The second timer module responsively energizes the relay switch 44 so that the switch contacts are closed and power is conducted to the high blower motor winding 24.

In the event that the relay switch 28 does not open, for example because it has been inadvertently soldered or welded closed, the monitoring module 40 prevents the transmission of power from the lead 46. If the monitoring module were not present, higher level power would conduct through the lead 46, while the switch 28 was closed, that would potentially damage the low blower winding 22 because an excessive amount of power would be supplied to that winding. Therefore, the monitoring module 40 operates to selectively control the supply of power to the components within the assembly 20 based upon proper operation of the relay switch 28.

Figure 2:
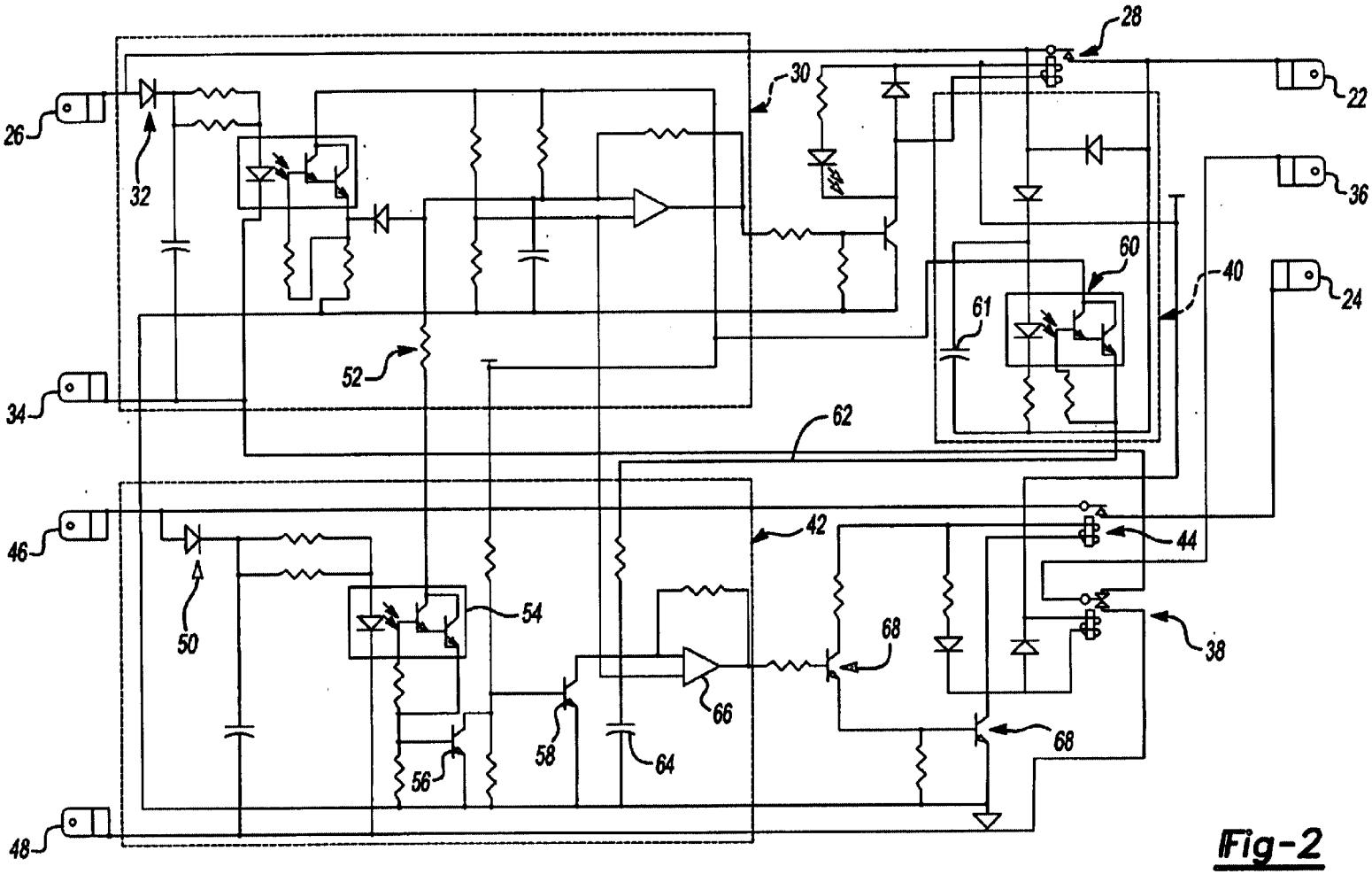
FIG. 2 schematically illustrates, in somewhat more detail, an example circuit designed according to this invention.

FIG. 2 schematically illustrates an example monitoring module 40. This example implementation includes discrete circuit components as part of the monitoring module. Another example implementation includes a suitably programmed microprocessor that performs the functions of monitoring the state of the relay switch and controlling at least one other portion of the assembly 20 based upon the state of the relay switch.

Assume that the low motor winding 22 is energized because power is conducted from the lead 26 across the relay switch 28, when it is in a closed position. Assume further that a signal is received across the lead 46 indicating a desire to operate the high speed motor winding 24. The signal is handled by the AC-to-DC converter 50 and the timer disable circuit portion 52 which disables the timer module 30. This results in de-energizing the relay switch 28 so that the switch contacts should open. The same signal received at the lead 46 energizes an opto isolator 54, which turns on the switch 56. This, in turn, pulls the base of the switch 58 low so that the switch 58 is turned off.

When the switch contacts of the relay switch 28 are open and a voltage exists across the contacts, the opto isolator 60 is energized, which provides voltage across capacitor 61. An output signal from opto isolator 60 along the lead 62 from the monitoring module 40 charges the capacitor 64. This results in the op amp 66 going high and consequently turns on the switch 68 to energize the relay switch 44 and relay switch 38. When the relay switch 44 is turned on (i.e., the switch contacts are closed), then the high speed motor winding 24 is energized and operates with motor common 36 going through operated relay switch 38 to lead 48.

In the event that the relay switch 28 does not operate as expected, the opto isolator 60 is not energized and no output signal is provided along the lead 62. In this circumstance, the switch 58 is off and no voltage is supplied to the capacitor 64. Without a charge on the capacitor 64, the op amp 66 and switch 68 do not operate so that both the relay 44 and 38 are not energized and no power is conducted along the line from the lead 46 to the lead 48. Therefore, whenever the relay switch 28 is not open as desired, the winding 22 is protected from receiving an excessive amount of power as would be conducted along the circuit running from the lead 46 to the lead 48. Because the low speed motor winding 22 preferably is energized using a lower level of power, the relay monitoring module 40 protects the low speed winding from being excessively powered.

The first timer module 30 and the second timer module 42 preferably introduce a two second delay between the time that a signal is received across the respective lead 26 or 46 and the time that the respective relay switch is energized to power the appropriate motor winding.

The preceding description is exemplary rather than limiting in nature.

Variations and modifications to the disclosed example may become apparent to those skilled in the art that do not necessarily depart from the essence of this invention. For example, one or more microprocessors may be suitably programmed to perform the functions of one or more portions of the illustrated circuitry. Given this description, those skilled in the art will be able to choose from among commercially available microprocessors and suitably program them to accomplish the results provided by this invention. Similarly, given this description, those skilled in the art will be able to choose from among commercially available circuit components or to custom design circuitry to achieve the same results provided by the illustrated example.

The scope of legal protection given to this invention can only be determined by studying the following claims.

We claim:

1. A system for controlling an air conditioning system, comprising:

a first winding that is powered at a first level for a low blower operation and a second winding that is powered at a second, higher power level for a high blower operation;

a first relay switch that is selectively controlled to supply power to the first winding;

a second relay switch that is selectively controlled to selectively supply power to the second winding;

a relay monitoring module that monitors the operation of at least the first relay switch and responsively controls operation of the second relay switch based upon the operating state of the first relay switch;

a first timer module that controls operation of the first relay switch, a second timer module that controls operation of the second relay switch and wherein the relay monitoring module controls operation of the second timer module; and a timer disable portion that selectively disables the first timer module to thereby disable the first relay switch.

2. The system of claim 1, wherein the second relay switch is selectively controlled to conduct current to the second motor winding independent of the first relay switch.

3. The system of claim 1, wherein the second relay switch is selectively enabled to supply power to the second motor winding only when the first relay switch is set such that no power is supplied to the first motor winding when the second relay switch is enabled.

4. A system for controlling an air conditioning system, comprising:

a first winding that is powered at a first level for a low blower operation and a second winding that is powered at a second, higher power level for a high blower operation;

a first relay switch that is selectively controlled to supply power to the first winding;

a second relay switch that is selectively controlled to selectively supply power to the second winding;

a relay monitoring module that monitors the operation of at least the first relay switch and responsively controls operation of the second relay switch based upon the operating state of the first relay switch:

a first timer module that controls operation of the first relay switch, a second timer module that controls operation of the second relay switch and wherein the relay monitoring module controls operation of the second timer module and the relay monitoring module disables the second timer module responsive to determining that the first relay switch is not operating as intended.

5. The system of claim 4, wherein the relay monitoring module provides an output signal that energizes the second timer module for operating the second relay switch.

6. The system of claim 1, wherein A system for controlling an air conditioning system, comprising:

a first winding that is powered at a first level for a low blower operation and a second winding that is powered at a second, higher power level for a high blower operation;

a first relay switch that is selectively controlled to supply power to the first winding;

a second relay switch that is selectively controlled to selectively supply power to the second winding;

a relay monitoring module that monitors the operation of at least the first relay switch and responsively controls operation of the second relay switch based upon the operating state of the first relay switch, the relay monitoring module including an opto isolator that is energized when the first relay switch is in a selected operating state.

7. The system of claim 6, wherein the selected operating state of the first relay switch is when the switch is open.

8. The system of claim 1, including a two stage motor having the first and second motor windings.

9. The system of claim 4, including a two stage motor having the first and second motor windings.

10. The system of claim 6, including a two stage motor having the first and second motor windings.

* * * * *